US010392586B2

(12) United States Patent
Campbell et al.

(10) Patent No.: US 10,392,586 B2
(45) Date of Patent: Aug. 27, 2019

(54) AUTOMATIC DISHWASHING COMPOSITIONS HAVING A DETERGENT GRANULE

(71) Applicant: Reckitt Benckiser N.V., Hoofddorp (NL)

(72) Inventors: Stuart Campbell, Ludwigshafen (DE); Karlheinz Hahn, Ludwigshafen (DE); Laurent Kirchhoffer, Chachoengsao (TH); Lucia Krubasik, Ludwigshafen (DE); Judith Preuschen, Ludwigshafen (DE); Dietmar Van Loyen, Ludwigshafen (DE)

(73) Assignee: RECKITT BENCKISER FINISH B.V., Hoofddorp (NL)

( * ) Notice: Subject to any disclaimer, the term of this patent is extended or adjusted under 35 U.S.C. 154(b) by 0 days.

(21) Appl. No.: 14/421,431

(22) PCT Filed: Aug. 6, 2013

(86) PCT No.: PCT/GB2013/052096
§ 371 (c)(1),
(2) Date: Feb. 12, 2015

(87) PCT Pub. No.: WO2014/027181
PCT Pub. Date: Feb. 20, 2014

(65) Prior Publication Data

US 2015/0166943 A1 Jun. 18, 2015

(30) Foreign Application Priority Data

Aug. 15, 2012 (GB) ..... 1214558.7

(51) Int. Cl.

| | |
|---|---|
| ***C11D 17/00*** | (2006.01) |
| ***C11D 3/33*** | (2006.01) |
| ***C11D 17/04*** | (2006.01) |
| ***C11D 17/06*** | (2006.01) |
| ***C11D 3/08*** | (2006.01) |
| ***C11D 3/37*** | (2006.01) |

(52) U.S. Cl.
CPC ..... *C11D 17/0039* (2013.01); *C11D 3/08* (2013.01); *C11D 3/33* (2013.01); *C11D 3/3753* (2013.01); *C11D 17/044* (2013.01); *C11D 17/045* (2013.01); *C11D 17/06* (2013.01)

(58) Field of Classification Search
CPC .. C11D 3/046; C11D 3/08; C11D 3/33; C11D 7/10; C11D 7/14; C11D 7/32; C11D 7/3245; C11D 17/06; C11D 17/065; B08B 3/04
USPC ..... 510/220, 224, 229, 499, 511; 134/25.2
See application file for complete search history.

(56) References Cited

U.S. PATENT DOCUMENTS

| | | | | |
|---|---|---|---|---|
| 6,162,259 | A | 12/2000 | Williams | |
| 2007/0015674 | A1* | 1/2007 | Song | C11D 3/06 510/220 |
| 2008/0171684 | A1* | 7/2008 | Boutique | C11D 3/0015 510/299 |
| 2008/0188391 | A1 | 8/2008 | Seebeck et al. | |
| 2009/0005287 | A1* | 1/2009 | Boutique | C11D 3/3788 510/299 |
| 2010/0115708 | A1* | 5/2010 | Caswell | A47F 1/08 8/137 |
| 2010/0190678 | A1* | 7/2010 | Busch | C11D 3/3932 510/310 |
| 2010/0229312 | A1* | 9/2010 | De Buzzaccarini | C11D 3/0026 8/137 |
| 2010/0305014 | A1* | 12/2010 | Miralles | C11D 1/825 510/138 |
| 2011/0263474 | A1* | 10/2011 | Somerville Roberts | C11D 3/33 510/229 |
| 2012/0067373 | A1* | 3/2012 | Souter | C11D 3/33 134/18 |
| 2014/0018278 | A1* | 1/2014 | Song | C11D 3/0073 510/224 |
| 2014/0073554 | A1 | 3/2014 | Van Der Eerden et al. | |

FOREIGN PATENT DOCUMENTS

| | | | |
|---|---|---|---|
| DE | 4213036 | A1 | 10/1993 |
| EP | 2380961 | A1 | 10/2011 |
| EP | 2392638 | A1 | 12/2011 |
| WO | 2009024780 | A1 | 2/2009 |
| WO | 2009092699 | A1 | 7/2009 |
| WO | 2009103822 | A1 | 8/2009 |
| WO | 2010116139 | A1 | 10/2010 |
| WO | 2012036703 | A1 | 3/2012 |
| WO | 2012066344 | A1 | 5/2012 |
| WO | WO2012/168739 | * | 12/2012 |

OTHER PUBLICATIONS

Combined Search and Examination Report for related GB Application No. 1214558.7 dated Nov. 21, 2012.
International Search Report for related PCT Application No. PCT/GB2013/052096 dated Nov. 5, 2011.

* cited by examiner

*Primary Examiner* — Gregory R Delcotto
(74) *Attorney, Agent, or Firm* — Troutman Sanders LLP; Ryan Schneider; Chris Davis

(57) ABSTRACT

The invention relates to detergent compositions comprising granular non-phosphate builder. The granules comprise an amino acid based builder, preferably MGDA, and s silicate. The composition is housed in a rigid PVOH capsule.

9 Claims, No Drawings

AUTOMATIC DISHWASHING COMPOSITIONS HAVING A DETERGENT GRANULE

CROSS-REFERENCE TO RELATED APPLICATIONS

This application is a US National Stage of International Application No. PCT/GB2013/052096 filed 6 Aug. 2013, which claims the benefit of GB 1214558.7 filed 15Aug. 2012, and each herein fully incorporated by reference.

The use of phosphates in detergent compositions has been banned by a number of authorities on environmental grounds. The United States, for example has had legislation in place preventing the use of phosphates for a couple of years. The European Union will follow in 2017.

This has proved a challenge for the makers of detergent compositions as phosphate is a very effective builder and is available at a very low cost.

The search for effective phosphate free builders has yielded a number of replacement compounds. These have largely proved effective in soft water conditions but finding a non-phosphate builder that has the ability to match phosphate performance in hard water has been much more problematic.

The most effective of these non-phosphate builders are the amino acid derived builders. These include glutamic acid N,N-diacetic acid (GLDA) and methylglycinediacetic acid (MGDA). These compounds are perhaps the only currently available p-free builders with performance equivalent to phosphate in hard water environments.

In addition to its superior builder performance, a major difference between MGDA and other alternative non phosphate compounds is the superior ecological and toxicological profile. MGDA is readily biodegradable according to several OECD standard tests. Unlike other products, MGDA is degraded under the standard conditions defined by the OECD and required by many local regulations.

These properties make MGDA currently the builder of choice for hard water areas particularly for automatic dishwashing (ADW) detergent compositions The use of MGDA is not without its problems however. These include being extremely hygroscopic, making processing and storage difficult, causing increased corrosion problems to tableware and glassware compared with phosphates and stability problems due to incompatibility with other ingredients, e.g. the bleach system.

It is the object of the present invention to obviate at least a proportion of the above problems.

In a first instance there is provided an ADW detergent composition comprising at least one granule, the at least one granule comprising an amino acid based builder and a silicate and wherein the composition is a mono-dose detergent composition housed within a rigid PVOH capsule with one or more compartments.

In a further embodiment, the at least one granule comprises at least 60% by weight of the amino acid based builder.

In a further embodiment, the amino acid based builder is MGDA.

In a further embodiment, the silicate comprises at least 0.5% by weight of the granule, preferably at least 1.0% by weight and more preferably at least 1.5% by weight.

In a further embodiment, the granule contains further optional ingredients.

In a further embodiment, the rigid PVOH capsule comprises an injection moulded structure.

In a further embodiment, the at least one granule comprises: MGDA 50-90% by weight; Silicate 1-30% by weight; and optional ingredients such as water 0-15% by weight.

In a further embodiment, the at least one granule has a diameter of 0.01 to 5 mm.

In a further embodiment, the composition comprises a plurality of granules.

In a second embodiment of the present invention there is provided the use of the detergent compositions according to the first embodiment of the invention in an automatic dishwashing detergent machine.

Solid agents in detergent compositions are preferentially used in granule form. This allows for safety and ease of handling.

MGDA is normally processed into a useable granular form for incorporation into ADW compositions. This process is not simple due to MGDAs inherent hygroscopic nature.

While looking to improve this process and develop more stable granules, the applicants surprisingly have found a new granule being capable of overcoming many of MGDAs shortcomings in detergent compositions.

The applicants have found that detergent compositions comprising co-granules of MGDA and silicates provide substantial benefits over granules of MGDA alone.

The granules of the present invention are available from the PQ corporation. The granules are prepared by co-granulation of the MGDA with silicate.

In particular the granules of the present invention provide improved stability when stored with bleach compounds.

Additionally ADW detergent compositions comprising the granules of the present invention had an improved aluminium corrosion protection profile over the standard granules in the art.

The granules provide a synergistic effect as the corrosion limiting effect of the granules is more than the effect of the combination of MGDA granules and the equivalent quantity of disilicates. Disilicates are known to have corrosion reducing properties in ADW detergent compositions.

The granules of the present invention preferably comprise at least 50% by weight MGDA, more preferably at least 65% by weight MGDA and most preferably at least 70% by weight of MGDA.

MGDA may be purchased in different grades of purity and with different stabilizing additives. For the purposes of the present invention the weight percentage figures quoted for MGDA relate to the quantity of the active compound.

The granules of the present invention may have at least 80% by weight MGDA. alternatively at least 90% by weight.

The granules of the present invention comprise silicate. For the purposes of the present invention silicate means any mixture of silicates or disilicates and related species.

Preferably the granules contain at least 0.5% by weight of silicate, more preferably at least 1.0% by weight, and most preferably at least 1.5% by weight silicates.

The granules of the present invention may have at least 5% by weight of silicates alternatively at least 10% by weight of silicates.

The granules may also contain other optional ingredients. The granules may contain between 0 and 15% by weight of additional ingredients.

Non-limiting examples of optional ingredients may be binders, dyes, coatings, lubricants, water etc.

The granules may comprise water, this may be at least 10wt %, alternatively at least 20wt %, alternatively at least 30 wt %.

The granules of the present invention have a mean diameter of between 0.01 mm to 5 mm, preferably between 0.05 mm to 3 mm and most preferably from 0.1 mm to 2 mm.

The granules of the present invention may be combined with other reagents to form a suitable ADW detergent composition. The detergent composition will be a mono-dose composition contained in a rigid poly vinyl alcohol (PVOH) capsule for ease of dosing.

Preferably the rigid PVOH capsule will take the form of an injection moulded capsule.

For the purposes of the present invention "rigid" may mean self-supporting, such that the empty/unfilled capsules may be capable of maintaining their own shape/form.

The skilled person will be aware of the kinds of ingredients needed to form an effective ADW detergent composition.

The ADW detergent composition may take any form known in the art. Possible forms include tablets, powders, gels, pastes and liquids. The detergent compositions may also comprise a mixture of two or more forms. For example the composition may comprise a gel component and a free powder component. The particles of the present invention may be contained within the gel portion or the powder portion of the detergent composition, or contained within both portions.

The detergent compositions are be housed in PVOH rigid capsules. These rigid PVOH capsules may have a single compartment or may be multi-compartment.

Multi-compartment capsules may have different portions of the composition in each compartment, or the same composition in each compartment. The distinct regions/or compartments may contain any proportion of the total amount of ingredients as desired.

The PVOH capsules may be filled with tablets, powders, gels, pastes or liquids, or combinations of these.

The detergent compositions may comprise any ingredients known in the art. These may comprise a secondary builder (or co-builder). These may be either a phosphorous-containing builder or a phosphorous-free builder as desired.

In many countries phosphate builders are banned.

If phosphorous-containing builders are also to be used it is preferred that mono-phosphates, di-phosphates, tri-polyphosphates or oligomeric-poylphosphates are used. The alkali metal salts of these compounds are preferred, in particular the sodium salts. An especially preferred builder is sodium tripolyphosphate (STPP). Conventional amounts of the phosphorous-containing builders may be used typically in the range of from 15% by weight to 70% by weight, such as from 20% by weight to 60% by weight or from 25% by weight to 50% by weight.

If additional phosphorous-free builder is included it is preferably chosen from succinate based compounds. The terms 'succinate based compound' and 'succinic acid based compound' are used interchangeably herein. Conventional amounts of the succinate based compounds may be used, typically in the range of from 05% by weight to 80% by weight, such as from 15% by weight to 70% by weight or from 20% by weight to 60% by weight. The compounds may be used individually or as a mixture.

Other suitable builders are described in U.S. Pat. No. 6,426,229 which are incorporated by reference herein. Particular suitable builders include; for example, aspartic acid-N-monoacetic acid (ASMA), aspartic acid-N,N-diacetic acid (ASDA), aspartic acid-N- monopropionic acid (ASMP), iminodisuccinic acid (IDA), N-(2-sulfomethyl) aspartic acid (SMAS), N-(2-sulfoethyl)aspartic acid (SEAS), N-(2-sulfomethyl)glutamic acid (SMGL), N-(2-sulfoethyl)glutamic acid (SEGL), N-methyliminodiacetic acid (MIDA), α-alanine-N,N-diacetic acid (α-ALDA), β-alanine-N,N-diacetic acid (β-ALDA), serine-N,N-diacetic acid (SEDA), isoserine-N,N-diacetic acid (ISDA), phenylalanine-N,N-diacetic acid (PHDA), anthranilic acid-N,N-diacetic acid (ANDA), sulfanilic acid-N,N-diacetic acid (SLDA), taurine-N, N-diacetic acid (TUDA) and sulfomethyl-N,N-diacetic acid (SMDA) and alkali metal salts or ammonium salts thereof.

Preferred examples include tetrasodium imminosuccinate. Iminodisuccinic acid (IDS) and (hydroxy)iminodisuccinic acid (HIDS) and alkali metal salts or ammonium salts thereof are especially preferred succinate based builder salts.

The phosphorous-free co-builder may also or alternatively comprise non-polymeric organic molecules with carboxylic group(s). Builder compounds which are organic molecules containing carboxylic groups include citric acid, fumaric acid, tartaric acid, maleic acid, lactic acid and salts thereof. In particular the alkali or alkaline earth metal salts of these organic compounds may be used, and especially the sodium salts. An especially preferred phosphorous-free builder is sodium citrate. Such polycarboxylates which comprise two carboxyl groups include, for example, water-soluble salts of, malonic acid, (ethylenedioxy)diacetic acid, maleic acid, diglycolic acid, tartaric acid, tartronic acid and fumaric acid. Such polycarboxylates which contain three carboxyl groups include, for example, water-soluble citrate. Correspondingly, a suitable hydroxycarboxylic acid is, for example, citric acid.

Preferred secondary builders include homopolymers and copolymers of polycarboxylic acids and their partially or completely neutralized salts, monomeric polycarboxylic acids and hydroxycarboxylic acids and their salts, phosphates and phosphonates, and mixtures of such substances. Preferred salts of the abovementioned compounds are the ammonium and/or alkali metal salts, i.e. the lithium, sodium, and potassium salts, and particularly preferred salts is the sodium salts. Secondary builders which are organic are preferred. A polymeric polycarboxylic acid is the homopolymer of acrylic acid. Other suitable secondary builders are disclosed in WO 95/01416, to the contents of which express reference is hereby made.

Preferably the total amount of builder present in the composition is at least 20% by weight, and most preferably at least 25% by weight, preferably in an amount of up to 70% by weight, preferably up to 60% by weight, more preferably up to 45% by weight. The actual amount used in the compositions will depend upon the nature of the builder used. If desired a combination of phosphorous-containing and phosphorous-free builders may be used.

Preferably the total amount of co-builder present is an amount of up to 10% by weight, preferably at least 5% by weight. The actual amount used in the compositions will depend upon the nature of the builder used.

The detergent compositions may include surfactants. Surfactant may also be included in the shaped body or detergent composition and any of nonionic, anionic, cationic, amphoteric or zwitterionic surface active agents or suitable mixtures thereof may be used. Many such suitable surfactants are described in Kirk Othmer's Encyclopedia of Chemical Technology, 3rd Ed., Vol. 22, pp. 360-379, "Surfactants and Detersive Systems", incorporated by reference herein. In general, bleach-stable surfactants are preferred according to the present invention.

Non-ionic surfactants are especially preferred according to the present invention, especially for automatic dishwashing compositions. For laundry and cleaning applications (excluding automatic dishwashing) other surfactants such as anionic surfactants are preferably included and suitable types are well known in the art.

A preferred class of nonionic surfactants is ethoxylated non-ionic surfactants prepared by the reaction of a monohydroxy alkanol with 6 to 20 carbon atoms. Preferably the surfactants have at least 12 moles particularly preferred at least 16 moles, and still more preferred at least 20 moles, such as at least 25 moles of ethylene oxide per mole of alcohol.

Particularly preferred non-ionic surfactants are the nonionics from a linear chain fatty alcohol with 16-20 carbon atoms and at least 12 moles, particularly preferred at least 16 and still more preferred at least 20 moles, of ethylene oxide per mole of alcohol.

According to one embodiment of the invention, the nonionic surfactants additionally may comprise propylene oxide units in the molecule. Preferably these PO units constitute up to 25% by weight, preferably up to 20% by weight and still more preferably up to 15% by weight of the overall molecular weight of the non-ionic surfactant.

Surfactants which are ethoxylated mono-hydroxy alkanols which additionally comprises polyoxyethylene-polyoxypropylene block copolymer units may be used. The alcohol portion of such surfactants constitutes more than 30% by weight, preferably more than 50% by weight, more preferably more than 70% by weight of the overall molecular weight of the non-ionic surfactant.

Another class of suitable non-ionic surfactants includes reverse block copolymers of polyoxyethylene and polyoxypropylene and block copolymers of polyoxyethylene and polyoxypropylene initiated with trimethylolpropane. Another preferred class of nonionic surfactant can be described by the formula:

$$R^1O[CH_2CH(CH_3)O]X[CH_2CH_2O]Y[CH_2CH(OH)R^2]$$

where $R^1$ represents a linear or branched chain aliphatic hydrocarbon group with 4-18 carbon atoms or mixtures thereof, $R^2$ represents a linear or branched chain aliphatic hydrocarbon rest with 2-26 carbon atoms or mixtures thereof, x is a value between 0.5 and 1.5 and y is a value of at least 15.

Another group of preferred nonionic surfactants are the end-capped polyoxyalkylated non-ionics of formula:

$$R^1O[CH_2CH(R^3)O]X[CH_2]kCH(OH)[CH_2]jOR^2$$

where $R^1$ and $R^2$ represent linear or branched chain, saturated or unsaturated, aliphatic or aromatic hydrocarbon groups with 1-30 carbon atoms, $R^3$ represents a hydrogen atom or a methyl, ethyl, n-propyl, iso-propyl, n-butyl, 2-butyl or 2-methyl-2-butyl group, x is a value between 1 and 30 and, k and j are values between 1 and 12, preferably between 1 and 5. When the value of x is >2 each R3 in the formula above can be different. $R^1$ and $R^2$ are preferably linear or branched chain, saturated or unsaturated, aliphatic or aromatic hydrocarbon groups with 6-22 carbon atoms, where group with 8 to 18 carbon atoms are particularly preferred. For the group $R^3$ H, methyl or ethyl is particularly preferred. Particularly preferred values for x are comprised between 1 and 20, preferably between 6 and 15.

As described above, in case x>2, each $R^3$ in the formula can be different. For instance, when x=3, the group $R^3$ could be chosen to build ethylene oxide ($R^3$=H) or propylene oxide ($R^3$=methyl) units which can be used in every single order for instance (PO)(EO)(EO), (EO)(PO)(EO), (EO)(EO)(PO), (EO)(EO)(EO), (PO)(EO)(PO), (PO)(PO)(EO) and (PO)(PO)(PO). The value 3 for x is only an example and bigger values can be chosen whereby a higher number of variations of (EO) or (PO) units would arise.

Particularly preferred end-capped polyoxyalkylated alcohols of the above formula are those where k=1 and j=1 originating molecules of simplified formula:

$$R^1O[CH_2CH(R^3)O]XCH_2CH(OH)CH_2OR^2$$

The use of mixtures of different nonionic surfactants is suitable in the context of the present invention for instance mixtures of alkoxylated alcohols and hydroxy group containing alkoxylated alcohols.

Other suitable surfactants are disclosed in WO 95/01416, to the contents of which express reference is hereby made.

Preferably the non-ionic surfactants are present in the detergent composition in an amount of from 0.1% by weight to 20% by weight, more preferably 1% by weight to 15% by weight, such as 2% to 10% by weight based on the total weight of the detergent composition.

The detergent compositions may also include enzymes. It is preferred that the enzyme is selected from proteases, lipases, amylases, cellulases and peroxidases, with proteases and amylases, especially proteases being most preferred. It is most preferred that protease and/or amylase enzymes are included in the compositions according to the invention as such enzymes are especially effective for example in dishwashing detergent compositions. Any suitable species of these enzymes may be used as desired. More than one species may be used.

The detergent compositions may also comprise bleach additives or bleach activation catalysts. The composition may preferably comprise one or more bleach activators or bleach catalysts depending upon the nature of the bleaching compound. Any suitable bleach activator may be included for example TAED if this is desired for the activation of the bleach material. Any suitable bleach catalyst may be used for example manganese oxalate, manganese acetate or dinuclear manganese complexes such as those described in EP-A-1,741,774. The organic peracids such as perbenzoic acid and peroxycarboxylic acids e.g. PAP do not require the use of a bleach activator or catalyst as these bleaches are active at relatively low temperatures such as about 30° C. and this contributes to such bleach materials being especially preferred according to the present invention.

Water may be included in the detergent composition.

The detergent compositions may also comprise a source of acidity or a source of alkalinity, to obtain the desired pH, on dissolution, especially if the composition is to be used in an automatic dishwashing application. Preferred silicates are sodium silicates such as sodium disilicate, sodium metasilicate and crystalline phyllosilicates. A source of acidity may suitably be any suitable acidic compound for example a polycarboxylic acid such as citric acid. For example a source of alkalinity may be a carbonate or bicarbonate (such as the alkali metal or alkaline earth metal salts). A source of alkalinity may suitably be any suitable basic compound for example any salt of a strong base and a weak acid. When an alkaline composition is desired silicates are amongst the suitable sources of alkalinity.

The detergent compositions may comprise one or more anti-corrosion agents, especially when the detergent compositions are for use in automatic dishwashing operations. These anti-corrosion agents may provide benefits against corrosion of glass and/or metal and the term encompasses agents that are intended to prevent or reduce the tarnishing of non-ferrous metals, in particular of silver and copper.

It is known to include a source of multivalent ions in detergent compositions, and in particular in automatic dishwashing compositions, for anti-corrosion benefits. For example, multivalent ions and especially zinc, bismuth and/or manganese ions have been included for their ability to inhibit such corrosion. Organic and inorganic redox-active substances which are known as suitable for use as silver/copper corrosion inhibitors are mentioned in WO 94/26860 and WO 94/26859. Suitable inorganic redox-active substances are, for example, metal salts and/or metal complexes chosen from the group consisting of zinc, bismuth, manganese, titanium, zirconium, hafnium, vanadium, cobalt and cerium salts and/or complexes, the metals being in one of the oxidation states II, III, IV, V or VI. Particularly suitable metal salts and/or metal complexes are chosen from the group consisting of $MnSO_4$, Mn(II) citrate, Mn(II) stearate, Mn(II) acetylacetonate, Mn(II) [1-hydroxyethane-1,1-diphosphonate], $V_2O_5$, $V_2O_4$, $VO_2$, $TiOSO_4$, $K_2TiF_6$, $K_2ZrF_6$, $CoSO_4$, $Co(NO_3)_2$, Zinc acetate, Zinc sulphate and $Ce(NO_3)_3$. Any suitable source of multivalent ions may be used, with the source preferably being chosen from sulphates, carbonates, acetates, gluconates and metal-protein compounds. Zinc salts are specially preferred corrosion inhibitors.

Preferred silver/copper anti-corrosion agents are benzotriazole (BTA) or bis-benzotriazole and substituted derivatives thereof. Other suitable agents are organic and/or inorganic redox-active substances and paraffin oil. Benzotriazole derivatives are those compounds in which the available substitution sites on the aromatic ring are partially or completely substituted. Suitable substituents are linear or branch-chain $C_{1-20}$ alkyl groups and hydroxyl, thio, phenyl or halogen such as fluorine, chlorine, bromine and iodine. A preferred substituted benzotriazole is tolyltriazole.

Any conventional amount of the anti-corrosion agents may be included. However, it is preferred that they are present in an total amount of from 0.01% by weight to 5% by weight, preferably 0.05% by weight to 3% by weight, more preferably 0.1% by weight to 2.5% by weight, such as 0.2% by weight to 2% by weight based on the total weight.

Polymers intended to improve the cleaning performance of the detergent compositions may also be included therein. For example sulphonated polymers may be used. Preferred examples include copolymers of $CH_2{=}CR^1\text{-}CR^2R^3\text{—}O\text{—}C_4H_3R^4\text{—}SO_3X$ wherein $R^1$, $R^2$, $R^3$, $R^4$ are independently 1 to 6 carbon alkyl or hydrogen, and X is hydrogen or alkali with any suitable other monomer units including modified acrylic, fumaric, maleic, itaconic, aconitic, mesaconic, citraconic and methylenemalonic acid or their salts, maleic anhydride, acrylamide, alkylene, vinylmethyl ether, styrene and any mixtures thereof. Other suitable sulfonated monomers for incorporation in sulfonated (co)polymers are 2-acrylamido-2-methyl-1-propanesulphonic acid, 2-methacrylamido-2-methyl-1-propanesulphonic acid, 3-methacrylamido-2-hydroxy-propanesulphonic acid, allysulphonic acid, methallysulphonic acid, 2-hydroxy-3-(2-propenyloxy) propanesulphonic acid, 2-methyl-2-propenen-1-sulphonic acid, styrenesulphonic acid, vinylsulphonic acid, 3-sulphopropyl acrylate, 3-sulphopropylmethacrylate, sulphomethylacrylamide, sulphomethylmethacrylamide and water soluble salts thereof. Suitable sulphonated polymers are also described in U.S. Pat. No. 5,308,532 and in WO 2005/090541.

When a sulfonated polymer is present, it is preferably present in an amount of at least 0.1% by weight, preferably at least 0.5% by weight, more preferably at least 1% by weight, and most preferably at least 3% by weight, up to 40% by weight, preferably up to 25% by weight, more preferably up to 15% by weight, and most preferably up to 10% by weight.

The detergent composition may also comprise one or more foam control agents. Suitable foam control agents for this purpose are all those conventionally used in this field, such as, for example, silicones and their derivatives and paraffin oil. The foam control agents are preferably present in amounts of 0.5% by weight or less.

The detergent compositions may also comprise minor, conventional, amounts of preservatives.

EXPERIMENTAL

Granules—The following table shows the granules compared. Samples 1 and 2 constitute granules within the claimed invention. Sample 3 is a control, Trilon M™, purchased from BASF.

| | Granules tested | | |
|---|---|---|---|
| | 1 | 2 | 3 |
| Active MGDA content | 76.0% | 73.0% | 78.0% |
| Silicate content | 5.6% | 11.0% | 0.0% |
| Water content | 11.5% | 11.0% | 15.0% |

All of the granules tested had a bulk density between 700 and 850 g/L.

Test Detergent Base:

| Category | Chemicals | Weight % |
|---|---|---|
| Bleach | Percarbonate, TAED, MnOxalate | 21.3% |
| Builder | Granules (1-3) | 41.0% |
| Co-builder/ other builder | HEDP, Trisodium citrate, Homopolymer | 4.0% |
| Alkali | Sodium carbonate, Sodium bicarbonate | 23.4% |
| Binder | PEG 6000, PEG 1500 | 4.1% |
| Enzymes | Protease, Amylase | 2.0% |
| Dye/antifoam Perfume etc | | 0.7% |
| Surfactant | Lutensol AT 25 | 3.2% |
| Protector | TTA | 0.3% |

ADW Detergent compositions comprising the 3 different detergent granules were tested for cleaning performance and were found to have comparable performance.

Stability Testing:

MGDA is known to have a deleterious effect on bleaches. The granules 1, 2 and 3 were tested by storage with sodium percarbonate for 4 weeks at 40° C. and 75% relative humidity.

At the end of this time, sample 3 had strong brown discolouration resulting from the chemical reaction of an organic molecule with percarbonate. The combination of granules 1 and 2 and sodium percarbonate showed no discolouration.

This shows the compositions of the present invention offer a clear stability advantage over those containing standard MGDA granules.

Aluminium corrosion profile.

MGDA is known to have a high corrosion effect on aluminium. ADW compositions comprising MGDA in granule form according to the present invention were found to vastly reduce this corrosion effect.

| Composition tested | Aluminium corrosion scores by visual inspection after 10 washes (1-5) |
|---|---|
| Detergent with granule 1 | 3 |
| Detergent with granule 3 plus equivalent disilicate. | 2.5 |

Number of cycles: 10
Dishwasher type: Miele 977 SC plus
Water hardness: <1° dH (centrally ion exchanged)
Program: 65° C. cleaning, 65° C. rinse-cycle The aluminium articles are visually examined. The scores range from:

5=no damages/modifications
4=minor damages, hardly visible
3=visible damages
2=strong damages
1=very strong damages, clearly visible A score of 0.5 less is visually significant over ten wash cycles.

As silicate is known to reduce corrosion itself, a further control experiment was carried out to allow for this. The compositions of the present invention have a more effective anti-corrosion effect than the simple addition of the equivalent amount of silicates to the compositions generally. Thus there is a synergistic protective effect associated with the compositions of the present invention.

The invention claimed is:

1. A method of automatic dishwashing in an automatic dishwashing machine, comprising:
providing a monodose automatic dishwashing detergent composition housed within a rigid polyvinyl alcohol capsule having one or more compartments; and
washing at least one aluminum-comprising article in an automatic dishwashing machine using the monodose automatic dishwashing detergent composition, wherein corrosion of the aluminum by the monodose automatic dishwashing detergent composition is inhibited;
wherein the monodose automatic dishwashing detergent composition consists of:
at least one non-ionic surfactant;
sodium citrate;
a bleaching compound;
a source of alkalinity;
a binder;
enzymes;
a dye;
an antifoam agent;
a fragrance;
a bleach activator;
a bleach catalyst;
a sulfonated polymer; and
at least one granule comprising, within the same granule, silicate together with methylglycine diacetic acid;
wherein the granule comprises 70-90% by weight methylglycine diacetic acid and 5-11% by weight of silicate,
wherein the total amount of builder present in the monodose automatic dishwashing detergent composition is up to 60% by weight, and
wherein the bleaching compound is a percarbonate bleach.

2. The method according to claim 1, wherein the at least one granule comprises at least one further ingredient.

3. The method according to claim 1, wherein the rigid polyvinyl alcohol capsule is selected from the group consisting of a thermoformed structure, a vacuum formed structure, an injection moulded structure, and a combination thereof.

4. The method according to claim 1, wherein the at least one granule further comprises:
0-15% by weight of optional ingredients.

5. The method according to claim 1, wherein the at least one granule has a diameter of 0.01 mm to 5 mm.

6. The method according to claim 1, wherein the composition comprises a plurality of the granules.

7. The method according to claim 1, wherein
the at least one non-ionic surfactant is present in an amount of 2% to 10% by weight based on the total weight of the detergent composition;
the sulfonated polymer is present in an amount of 0.1 to 10 wt % by weight based on the total weight of the detergent composition;
the antifoam agent is present in an amount of less than 0.5 wt % by weight based on the total weight of the detergent composition;
and the binder is present in an amount of about 4 wt % by weight based on the total weight of the detergent composition.

8. A method of automatic dishwashing in an automatic dishwashing machine, comprising:
providing a monodose automatic dishwashing detergent composition housed within a rigid polyvinyl alcohol capsule having one or more compartments; and
washing at least one aluminum-comprising article in an automatic dishwashing machine using the monodose automatic dishwashing detergent composition, wherein corrosion of the aluminum by the monodose automatic dishwashing detergent composition is inhibited; and
wherein the monodose automatic dishwashing detergent composition consists of:
at least one granule consisting of, within the same granule, methylglycine diacetic acid (MGDA), silicate and water;
percarbonate bleach;
at least one co-builder;
a source of alkalinity;
a binder;
enzymes;
a dye;
an antifoam agent;
a fragrance;
at least one non-ionic surfactant; and
a sulfonated polymer,
wherein the MGDA is present in the at least one granule in an amount of 70-90% by weight and the silicate is present in the at least one granule in an amount of 5-11% by weight, with the balance being water, and
wherein the total amount of builder present in the monodose automatic dishwashing detergent composition is up to 60% by weight.

9. The method according to claim 8, wherein
the at least one non-ionic surfactant is present in an amount of 2% to 10% by weight based on the total weight of the detergent composition;
the sulfonated polymer is present in an amount of 0.1 to 10 wt % by weight based on the total weight of the detergent composition;
the antifoam agent is present in an amount of less than 0.5 wt % by weight based on the total weight of the detergent composition;

and the binder is present in an amount of about 4 wt % by weight based on the total weight of the detergent composition.

* * * * *